US006561627B2

(12) United States Patent
Jarrold et al.

(10) Patent No.: US 6,561,627 B2
(45) Date of Patent: May 13, 2003

(54) THERMAL ACTUATOR

(75) Inventors: Gregory S. Jarrold, Henrietta, NY (US); John A. Lebens, Rush, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/726,945

(22) Filed: Nov. 30, 2000

(65) Prior Publication Data

US 2002/0093548 A1 Jul. 18, 2002

(51) Int. Cl.[7] ..... B41J 2/04
(52) U.S. Cl. ..... 347/54; 347/56
(58) Field of Search ..... 347/54, 56

(56) References Cited

U.S. PATENT DOCUMENTS

| | | | | |
|---|---|---|---|---|
| 5,552,924 A | | 9/1996 | Tregilgas | |
| 5,696,619 A | | 12/1997 | Knipe et al. | |
| 5,812,159 A | * | 9/1998 | Anagnostopoulos et al. | 347/55 |
| 5,942,054 A | | 8/1999 | Tregilgas et al. | |
| 6,067,797 A | | 5/2000 | Silverbrook | |
| 6,080,665 A | * | 6/2000 | Chen et al. | 438/653 |
| 6,180,427 B1 | * | 1/2001 | Silverbrook | 438/21 |
| 6,214,133 B1 | * | 4/2001 | Deevi et al. | 148/421 |

FOREIGN PATENT DOCUMENTS

| | | |
|---|---|---|
| WO | WO 99/03681 | 1/1999 |
| WO | WO 00/48938 | 8/2000 |

* cited by examiner

*Primary Examiner*—John Barlow
*Assistant Examiner*—Michael S Brooke
(74) *Attorney, Agent, or Firm*—Mark G. Bocchetti; William R. Zimmerli

(57) ABSTRACT

A thermal actuator is taught for a micro-electromechanical device. The thermal actuator includes a base element, a cantilevered element extending from the base element and normally residing in a first position. The cantilevered element includes a first layer constructed of a dielectric material having a low thermal coefficient of expansion and a second layer attached to the first layer, the second layer comprising intermetallic titanium aluminide. A pair of electrodes are connected to the second layer to allow an electrical current to be passed through the second layer to thereby cause the temperature of the second layer to rise, the cantilevered element deflecting to a second position as a result of the temperature rise of the second layer and returning to the first position when the electrical current through the second layer is ceased and the temperature thereof decreases. The thermal actuator has particular application in an inkjet device wherein a series of such inkjet devices form an inkjet printhead.

19 Claims, 6 Drawing Sheets

THERMAL ACTUATOR

FIELD OF THE INVENTION

The present invention relates generally to micro-electromechanical devices and, more particularly, to micro-electromechanical thermal actuators such as the type used in ink jet print heads.

BACKGROUND OF THE INVENTION

Micro-electro mechanical systems (MEMS) are a relatively recent development. Such MEMS are being used as alternatives to conventional electromechanical devices such as actuators, valves, and positioners. Micro-electro mechanical devices are potentially low cost, due to the use of microelectronic fabrication techniques. Novel applications are also being discovered due to the small size scale of MEMS devices.

Many potential applications of MEMS technology utilize thermal actuation to provide the motion needed in such devices. For example many actuators, valves, and positioners use thermal actuators for movement. In the design of thermal actuators it is desirable to maximize the degree of movement while also maximizing the degree of force supplied by the actuator upon activation. At the same time it is also desirable to minimize the power consumed by the actuator motion.

It is also advantageous that the cantilever type thermal actuator exhibits no change in intrinsic stress and repeatable actuator motion upon repeated thermal actuation of the actuator between 20° C. and 300° C. temperatures. It is also desirable that the resulting MEMS devices are capable of being produced in batch fashion using materials that are compatible with standard CMOS integrated circuit fabrication. This allows advantageous MEMS devices that are reliable, repeatable, and low in cost. Compatibility with CMOS processing also allows the integration of control circuitry with the actuator on the same device, further improving cost and reliability.

SUMMARY OF THE INVENTION

It is therefore an object of the present invention to provide a thermal actuator for a micromechanical device having an actuator beam with an improved degree of movement.

It is a further object of the present invention to provide a thermal actuator for a micromechanical device having an actuator beam that delivers an increased degree of force upon activation.

Yet another object of the present invention is to provide a cantilevered beam type thermal actuator that exhibits substantially no relaxation upon repeated thermal actuation of the actuator between 20° C. and 300° C. temperatures.

Briefly stated, the foregoing and numerous other features, objects and advantages of the present invention will become readily apparent upon a review of the detailed description, claims and drawings set forth herein. These features, objects and advantages are accomplished by fabricating a thermal actuator for a micro-electromechanical device comprising a base element and a cantilevered element extending from the base element, the cantilevered element normally residing in a first non-actuated position. The cantilevered element includes a first layer constructed of a dielectric material having a low thermal coefficient of expansion and a second layer of intermetallic titanium aluminide (Ti/Al) attached to the first layer. A pair of electrodes are connected to the second layer to allow an electrical current to be passed through the second layer to thereby cause the temperature of the second layer to rise. The heat generated as a result of the resistivity of the intermetallic titanium aluminide causes the cantilevered element to deflect to an actuated second position. The cantilevered element returns to the first position when the electrical current through the second layer is ceased and the temperature of the second layer decreases. The intermetallic titanium aluminide thin film comprising the second layer has a high coefficient of thermal expansion and is electrically conductive. Further, the intermetallic titanium aluminide thin film has suitable resistivity for use as a heater. With selected deposition conditions and post deposition annealing, a film with properly adjusted stress and thermal stability is formed.

The present invention is particularly useful as a thermal actuator inkjet printer device. In this preferred embodiment, the cantilevered element of the thermal actuator resides in an ink reservoir or chamber that includes a port or nozzle through which ink can be ejected. Through actuation of the thermal actuator, the cantilevered element deflects into the chamber forcing ink through the nozzle.

As stated above, the cantilevered element includes a first layer constructed of a dielectric material having a low thermal coefficient of expansion. The term "low thermal coefficient of expansion" as used herein is intended to mean a thermal coefficient of expansion that is less than or equal to 1 ppm/° C.

DETAILED DESCRIPTION OF THE INVENTION

Figure 1:
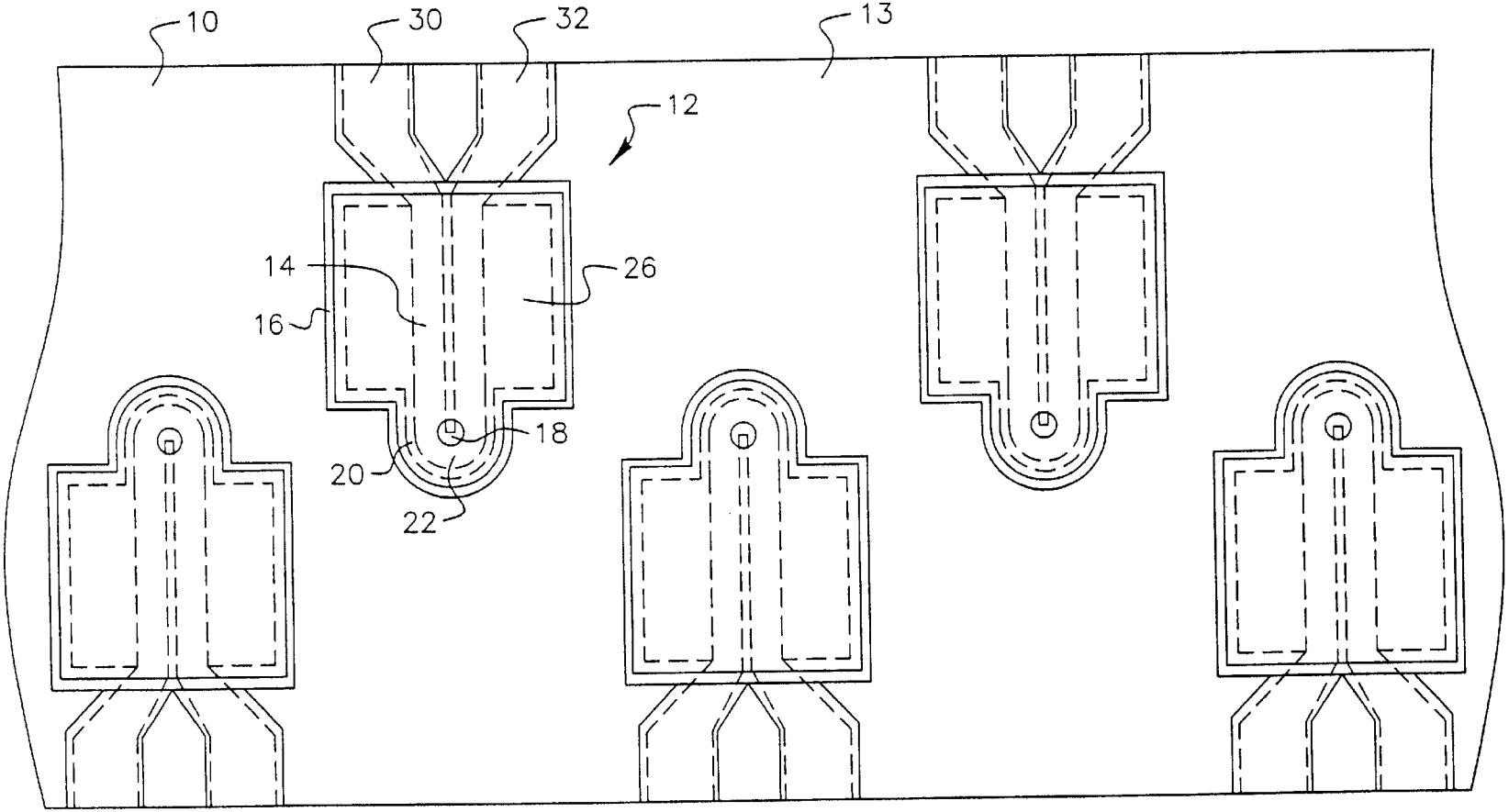
FIG. 1 is a plan view of a portion of a thermal actuator inkjet printhead having a plurality of the thermal actuator inkjet devices of the present invention formed therein.

Turning first to FIG. 1, there is shown a plan view of a portion of a thermal actuator inkjet printhead 10. An array of thermal actuator inkjet devices 12 is manufactured monolithically on a substrate 13. Each thermal actuator inkjet device 12 consists of a cantilevered element or beam 14 residing in an ink chamber 16. There is a nozzle or port 18 through which ink may be ejected from chamber 16. Nozzle or port 18 resides in pumping section 20 of chamber 16. The cantilevered element or beam 14 extends across chamber 16 such that the free end 22 thereof resides in pumping section 20. Cantilevered element or beam 14 fits closely within the walls of pumping section 20 without engaging such walls. By placing the cantilevered element or beam 14 in close proximity to nozzle 18 and tightly confining the cantilevered beam 14 in pumping section 20, the efficiency of the ink drop ejection is improved. Open regions 26 of chamber 16 adjacent cantilevered beam 14 allow for quick refill after drop ejection through nozzle 18. Ink is supplied to thermal actuator inkjet device 12 by an ink feed channel 28 (see FIG. 7) etched through the substrate 13 beneath the ink chamber 16. There are two addressing electrodes 30, 32 extending from cantilevered beam 14.

Figure 2:
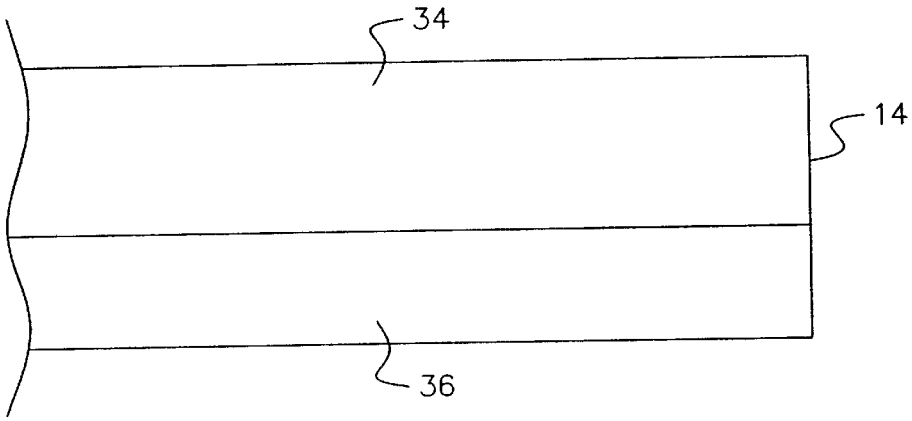
FIG. 2 is a side elevational view of a portion of the cantilevered beam of the thermal actuator inkjet device of the present invention.

Turning next to FIG. 2, cantilevered beam 14 is shown in cross-section. Cantilevered beam 14 includes a first or top layer 34 made of a material having a low coefficient of thermal expansion such as silicon dioxide, silicon nitride or a combination of the two. Cantilevered beam 14 also includes a second or bottom layer 36 which is electrically conductive and has a high efficiency as will be described hereinafter. Preferably, second layer 36 is comprised of intermetallic titanium aluminide.

FIGS. 3 through 6 illustrate the processing steps for one thermal actuator inkjet device 12. Looking at FIG. 3, the two addressing electrodes 30, 32 are connected to second layer 36. When a voltage is applied across the two electrodes 30, 32 current runs through the intermetallic titanium aluminide layer 36 heating it up and causing the cantilevered beam 14 to bend or deflect into pumping section 20 toward the nozzle 18. In this manner, ink is ejected through nozzle 18.

To optimize the ejection of a drop of ink in a thermal actuator inkjet device 12, it is important to optimize the force and deflection of the cantilevered beam 14. The following relation gives a dimensionless parameter that describes the efficiency $\epsilon$ of the material of the second layer 36 of the cantilevered beam 14:

$$\varepsilon = \frac{Y\alpha}{c_p\rho} \tag{1}$$

where $\alpha$ is the thermal coefficient of expansion, Y is the Young's modulus, $\rho$ is the density, and $c_p$ is the specific heat of the material. The numerator contains material properties proportional to the force and displacement of a thermal actuator. The denominator contains material properties that contribute to how efficiently the second layer 36 can be heated.

Table 1 shows $\epsilon$ for various materials that have been used for thermal actuators in the prior art in comparison with the intermetallic titanium aluminide thin film material of the present invention. Material properties were taken from the literature except for the intermetallic titanium aluminide thin film of the present invention for which the material values were derived from experiment.

TABLE 1

Efficiency of materials for thermal actuator

| Material | $\alpha(\times10^{-6})C^{-1}$ | $Y(\times10^{9})Pa$ | $\rho(x10^{3})Kg/m^{3}$ | $c_p$(J/Kg C) | $\epsilon$ |
|---|---|---|---|---|---|
| Al | 23.1 | 69 | 2.7 | 900 | .66 |
| Au | 14.3 | 80 | 19.3 | 1260 | .047 |
| Cu | 16.5 | 128 | 8.92 | 380 | .62 |
| Ni | 13.4 | 200 | 8.91 | 460 | .65 |
| Si | 2.6 | 180 | 2.33 | 712 | .28 |
| $TiAl_3$ | 15.5 | 188 | 3.32 | 780 | 1.13 |

The titanium aluminide film is 70% more efficient than the next best film of the prior art. The Young's modulus of the intermetallic titanium aluminide film was obtained from a fit to the resonant frequency of Ti/Al-silicon oxide cantilevers. The coefficient of thermal expansion of the intermetallic titanium aluminide film was obtained by heating the intermetallic titanium aluminide-silicon oxide cantilevers and fitting the deflection versus temperature.

The material used for the second or bottom layer 36 in the practice of the present invention has an efficiency ($\epsilon$) that is greater than about 1. Preferably, such material has an efficiency ($\epsilon$) that is greater than 1. Most preferably, such material has an efficiency ($\epsilon$) that is greater than 1.1.

For the case of a thermal actuator device 12 with a cantilevered beam 14, a two-layer structure is formed as discussed above with a first layer 34 and a second layer 36. The second layer 36 is preferably intermetallic titanium aluminide and the material of the first layer 34 has a substantially lower coefficient of thermal expansion. Typically, the material of the first layer 34 is chosen from silicon dioxide or silicon nitride. It should be clear to those skilled in the art that the displacement and force for a cantilevered beam 14 can also be optimized by varying the thickness and thickness ratios of the two materials chosen for layers 34, 36. In particular, it is known that in equilibrium, for maximum deflection and force, the following relation determines the ratio of the thickness of the first and second material:

$$\frac{h_2}{h_1} = \sqrt{\frac{Y_1}{Y_2}}, \tag{2}$$

where $h_1$, $h_2$ are the thickness of the two layers 34, 36 and $Y_1$, $Y_2$ are the Young's modulus of the materials of the two layers 34, 36.

Figure 3:
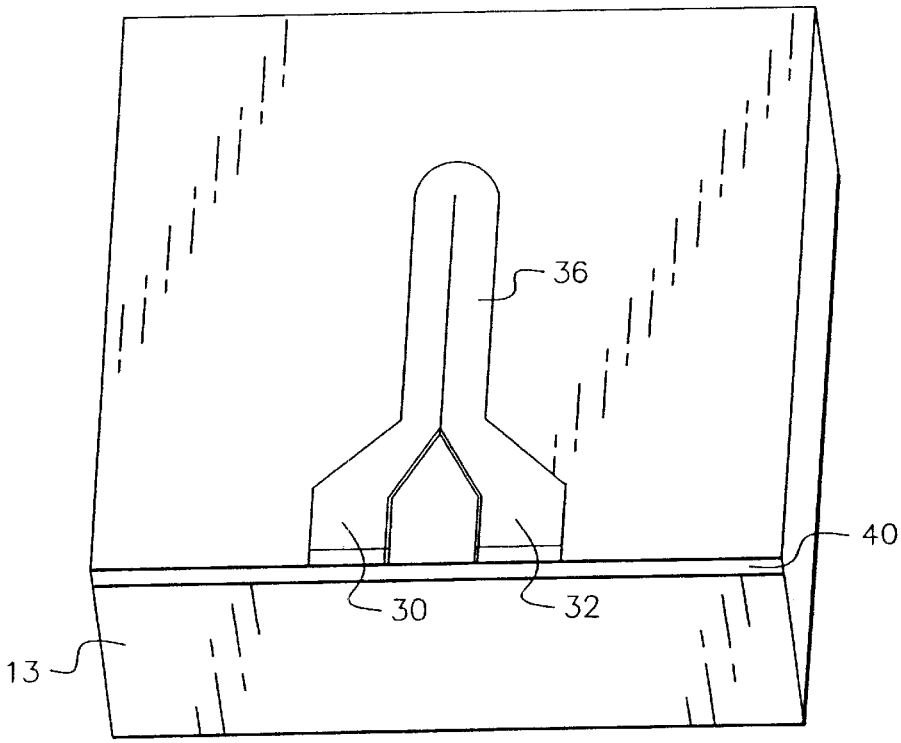
FIG. 3 is a perspective view early in the fabrication of the thermal actuator inkjet device wherein a thin layer typically consisting of silicon dioxide is first deposited on the substrate and the intermetallic titanium aluminide film is next deposited and patterned into the bottom layer.

As shown in FIG. 3, a thin layer 40 typically consisting of silicon dioxide is first deposited on the substrate 13 to act as a bottom protective layer for the thermal actuator inkjet device 12 from the ink and electrically insulate the thermal actuator inkjet device 12 from the substrate 13. The intermetallic titanium aluminide film is next deposited and patterned into the bottom layer 36 and addressing electrodes 30, 32 that extend off to connect to the control circuitry on the device.

Figure 4:
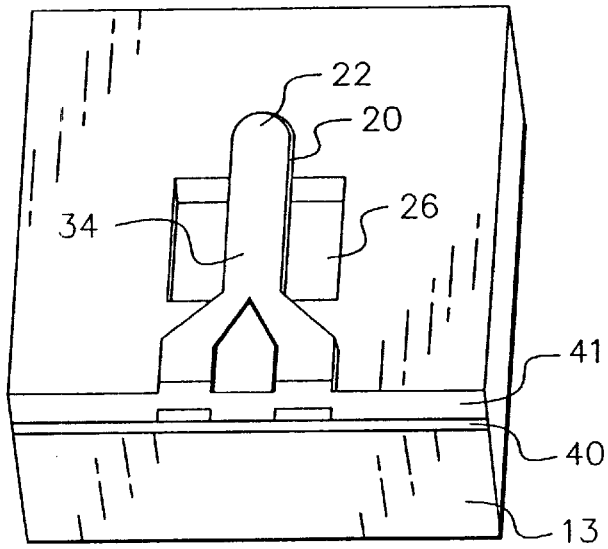
FIG. 4 is a perspective view of the thermal actuator inkjet device at a stage in the fabrication thereof later than that depicted in FIG. 3 wherein a dielectric layer has been patterned to form the top layer and the resulting pattern is then etched down through the thin layer of FIG. 3 down to the substrate.

Silicon oxide or a combination of silicon oxide and silicon nitride are deposited on thin layer 40 and bottom layer 36 to form dielectric layer 41 (see FIG. 4). Dielectric layer 41 is patterned to form the top layer 34 as shown in FIG. 4. The resulting pattern is then etched down through the thin layer 40 down to the substrate 13. The patterning of this layer 34 is extended beyond the pattern of the bottom layer 36 in order to leave a protective layer of oxide/nitride on the sides of the bottom layer 36. This patterning and etching also defines the open regions 26 on each side of the cantilevered beam 14 for ink refill, and defines a first layer of the pumping section 20 around the free end 22 of the cantilevered beam 14 for efficient drop ejection.

Figure 5:
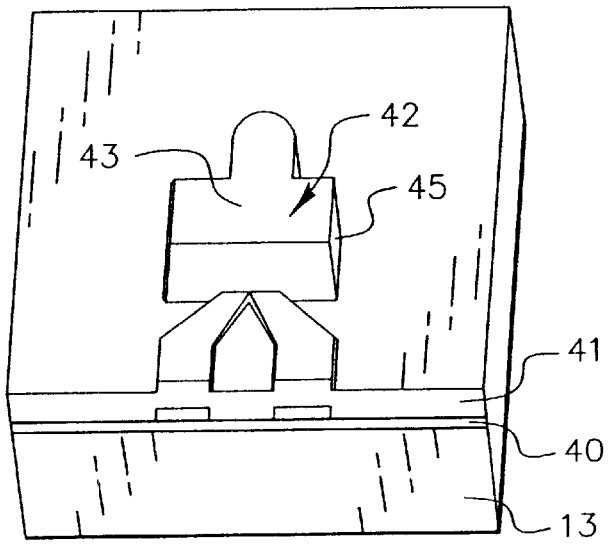
FIG. 5 is a perspective view of the thermal actuator inkjet device at a stage in the fabrication thereof later than that depicted in FIG. 4 wherein a sacrificial layer has been deposited, patterned and fully cured on the structure depicted in FIG. 4.

In FIG. 5, a polyimide sacrificial layer 42 is deposited, patterned and filly cured. The polyimide sacrificial layer 42 is defined to extend beyond the cantilevered beam 14 and fills the open regions 26 and pumping section 20. The cured definition of the polyimide sacrificial layer 42 provides the ink chamber 16 definition. The polyimide also planarizes the surface providing a flat top surface 43. The sloped sidewalls 45 of the polyimide aid in the formation of the ink chamber walls.

Figure 6:
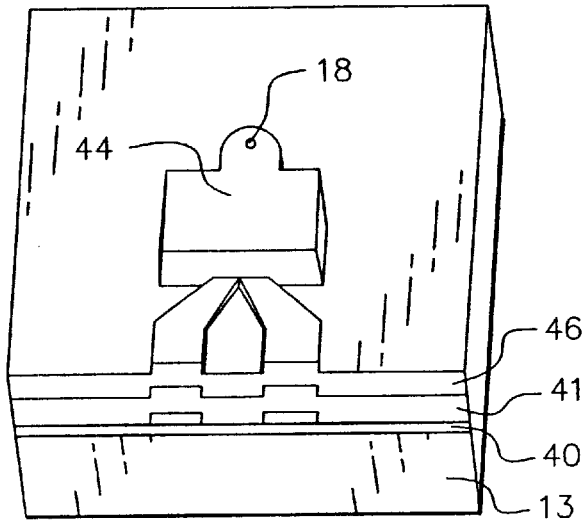
FIG. 6 is a perspective view of the thermal actuator inkjet device at a stage in the fabrication thereof later than that depicted in FIG. 5 wherein a top wall layer is next deposited on top of dielectric layer and the sacrificial layer depicted in FIG. 5.

A top wall layer 46 is next deposited on top of dielectric layer 41 as shown in FIG. 6. Typically this top wall layer 46 is composed of plasma deposited oxide and nitride which conformally deposits over the polyimide sacrificial layer 42. The sloped sidewalls 45 of the polyimide sacrificial layer 42 are important to prevent cracking of chamber wall layer 44 (which is part of top wall layer 46) at the top edge. The nozzle hole 18 is etched through the chamber wall layer 44.

The substrate 13 is then patterned on the backside, aligned to the front side, and etched through to form the ink feed line 28. The polyimide sacrificial layer 42 filling the ink chamber 16 is then removed by dry etch using oxygen and fluorine sources. This step also releases and thereby forms the cantilevered beam 14. Note that chip dicing can be done before this step to prevent debris from getting into the ink chamber 16.

Figure 7:
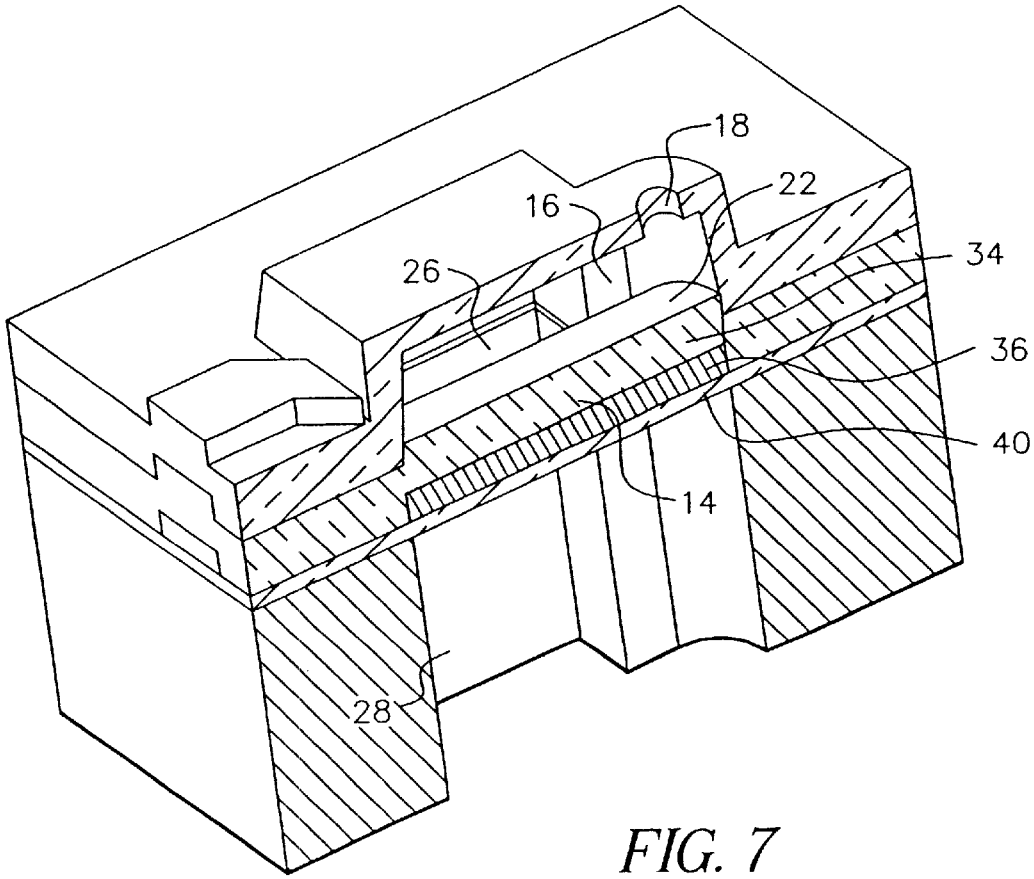
FIG. 7 is a sectioned perspective view of the thermal actuator inkjet device of the present invention.

A cross section of the final structure is shown in FIG. 7. The cross section of the cantilevered beam 14 shows the lower protective layer 40, the intermetallic titanium aluminide bottom actuator layer 36, and the top actuator layer 34. The cantilevered beam 14 resides in the ink chamber 16 and is tightly confined about the perimeter of the free end 22 in the vicinity of the nozzle hole 18 and has open fill regions 26 on each side for the rest of its length.

In order to keep the beam 14 straight as shown in FIG. 7, it is important to be able to control the stress of the material of the cantilevered beam 14. Stress differences between the layers 34, 36 of the cantilevered beam 14 will cause bending of the cantilevered beam 14. It is important therefore to be able to control the stress of each layer 34, 36. Preferably, the top actuator layer 34 is formed mainly of silicon oxide, which can be deposited with close to zero stress, with a second material such as silicon nitride on top of it which can be deposited with a tensile stress to counter any tensile stress of the second layer 36. To maximize the beam efficiency, however, it is important to minimize the amount of silicon nitride needed. Therefore, it is important to minimize the tensile stress of the intermetallic titanium aluminide film.

Deposition of the intermetallic titanium aluminide film was carried out using either RF or pulsed DC magnetron sputtering in argon gas. The $TiAl_3$ sputter target was certified to 99.95% purity and greater than 99.8% dense. Optimum film properties were obtained by varying the deposition parameters of pressure and substrate bias. For the case of pulsed DC magnetron sputtering the pulsing duty cycle was also varied. After deposition the film was annealed at 300° C.-350° C. for longer than one hour in a nitrogen atmosphere for a period long enough so that no further change in intrinsic stress was observed for the film. The annealed film shows a predominantly disordered face centered cubic (fcc) structure as determined by x-ray diffraction. The composition of the intermetallic titanium aluminide has a titanium to aluminum mole fraction in the range of 65–85% aluminum as determined by Rutherford Backscattering Spectrometry (RBS) dependent upon the selected sputtering conditions. This produces a film of superior properties than any presently taught for that of thermal actuation as described herein. This intermetallic material includes titanium and aluminum in a combination that can be characterized by the following relationship:

$$Al_{4-x}Ti_x,$$

where $0.6 \leqq x \leqq 1.4$.

When this predominantly fcc film is heated above 450° C. the crystal structure changes from the disordered fcc to a predominantly tetragonal $Ti_5Al_{11}$ structure. This change in structure is accompanied by a large increase in crystallite size and reduced tensile strength that can result in film cracks.

Figure 8:
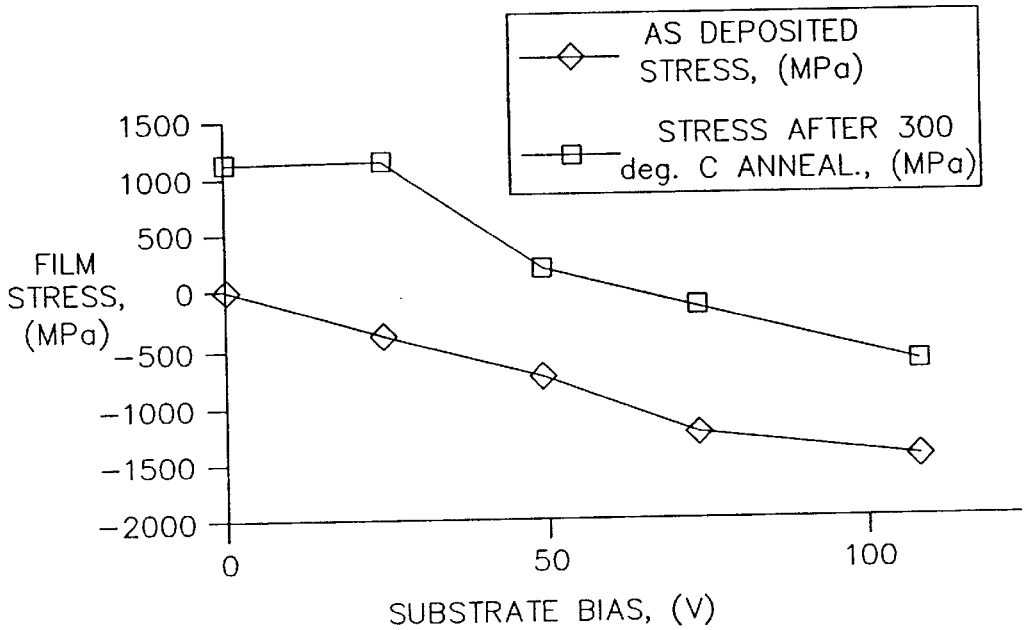
FIG. 8 is a graph plotting film stress as a function of substrate bias (before and after annealing at 300° C.) for titanium aluminide film.

FIG. 8 displays the experimental result of measured stress after deposition and the resulting stress after anneal. By controlling the deposition parameters the final stress of the film can be reduced to zero. Note that this displayed data was for deposition conditions of 5 mT pressure. We find also that as the deposition pressure is lowered below 6 mT an increase of the compressive stress is observed in the deposited film similar to increasing the bias. In addition, for DC magnetron sputtering, we find that varying the pulse duty cycle can also be used to adjust the stress. Therefore the final stress can be tailored through a proper selection of both substrate bias, deposition pressure and pulsing duty cycle.

Figure 9:
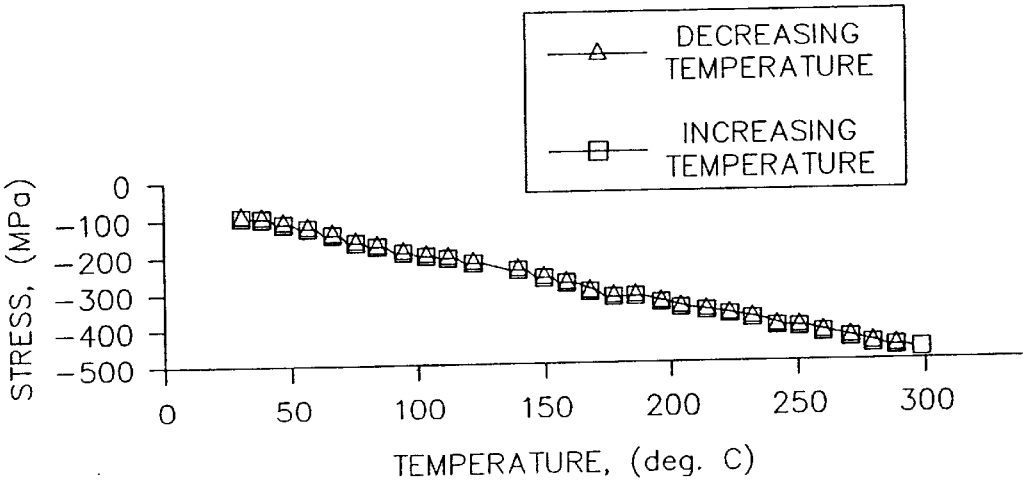
FIG. 9 is a graph plotting stress as a function of temperature for a deposited and annealed intermetallic titanium aluminide film measured on a six inch silicon wafer.
Figure 10:
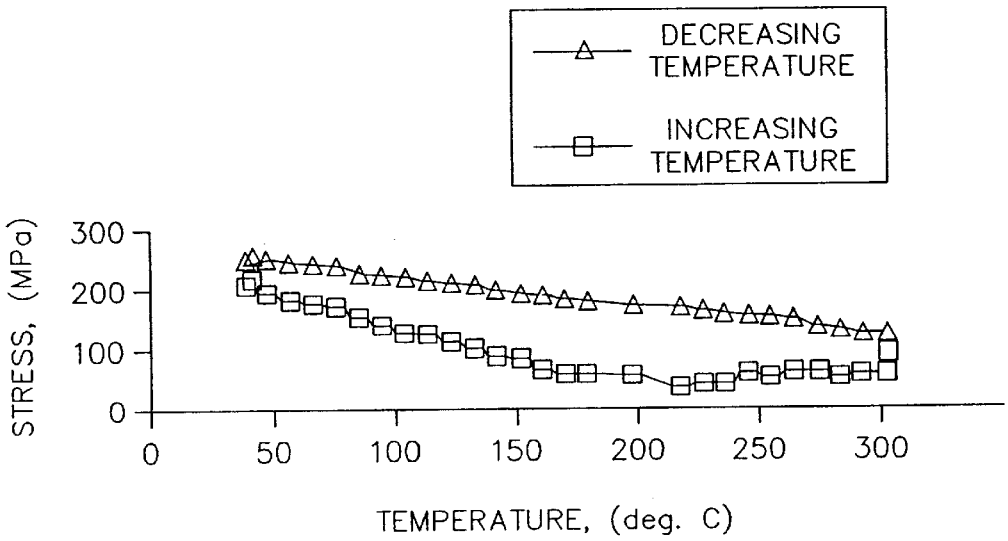
FIG. 10 is a graph plotting stress as a function of temperature for a sputtered aluminum film measured on a six inch silicon wafer.

It is also important that the material is thermally stable to repeated actuation, showing no plastic deformation or stress relaxation. FIG. 9 displays stress versus temperature data from a deposited and annealed intermetallic titanium aluminide film measured on a six inch silicon wafer. The curve shows no hysteresis. The same measurement on a pure aluminum film, shown in FIG. 10, shows large hysteresis and a nonlinear curve. On fabricated cantilevered beams 14 (including the intermetallic titanium aluminide film as described herein) tens of millions of test actuation have been performed with no measured change in cantilever profile or actuation efficiency.

Figure 11:
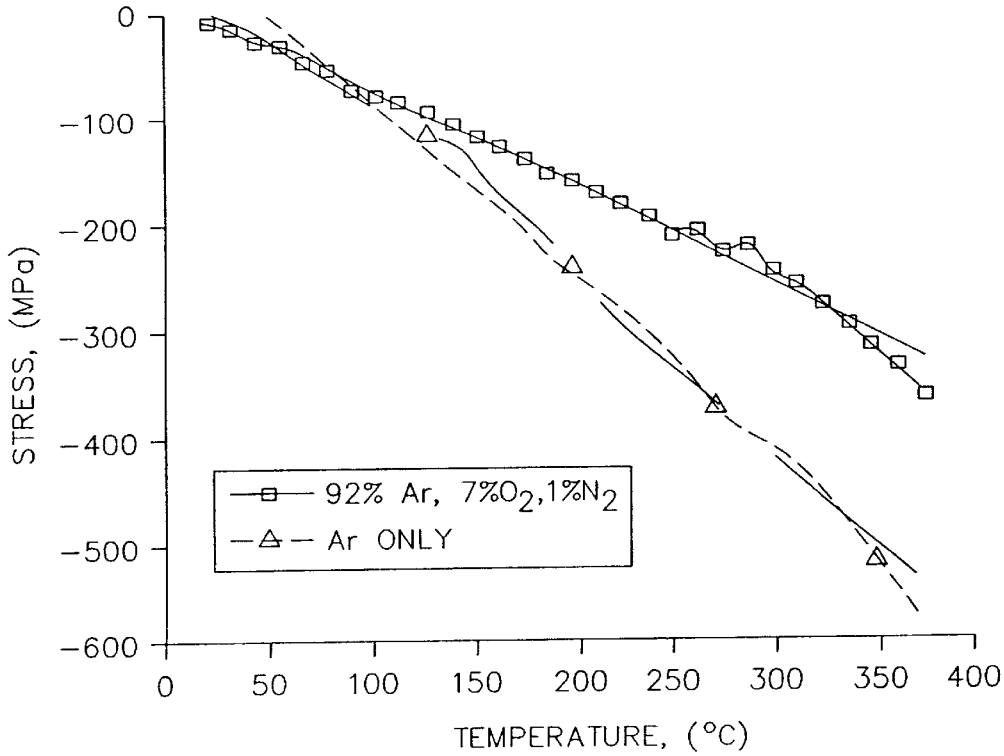
FIG. 11 is a graph plotting stress as a function of temperature showing a comparison of stress versus temperature curves for intermetallic titanium aluminide with 7% oxygen incorporated, and for intermetallic titanium aluminide with no oxygen incorporated, deposited on a silicon wafer.

It has also been found that addition of oxygen or nitrogen to the sputter gas to form TiAl(N) or TiAl(O) compounds is disadvantageous to the present invention. For example FIG. 11 compares the stress versus temperature curves for intermetallic titanium aluminide with 7% oxygen incorporated, and no oxygen incorporated, deposited on a silicon wafer. Measuring the wafer curvature, the stress of the film is derived using Stoney's equation as is well known in the art. The slope of the curve is proportional to the Young's modulus of the material and the thermal coefficient of expansion. A lower slope therefore indicates a less efficient actuator material. The addition of oxygen degrades the efficiency of the actuator material.

The intermetallic titanium aluminide material used for layer 36 demonstrates significant advantages over materials used in prior art thermal actuator devices. Such material has a high thermal coefficient of expansion which is proportional to the amount of deflection that the cantilevered beam 14 can achieve for a given temperature rise. It is also proportional to the amount of force the cantilevered beam 14 can apply for a given temperature rise. In addition, the intermetallic titanium aluminide material has a high Young's modulus. A higher Young's modulus means the same force can be applied with a thinner cantilevered beam 14 thus increasing the deflection capability of the cantilevered beam 14. Intermetallic titanium aluminide also has a low density and a low specific heat. Lower energy input is required to heat the material to a given temperature. These properties allow for fabrication of small scale thermal actuator cantilevered beams 14 that can achieve fast response time consistent with use as an ink drop ejector for printing. By way of example, cantilevered beams 14 of the present invention having dimensions of 20 $\mu$m wide×100 $\mu$m long and with a thickness of 2.8 $\mu$m have been successfully produced and tested in an ink jet printing operation.

The intermetallic titanium aluminide material used for layer 36 shows no plastic relaxation or hysteresis upon repeated heating to 300° C. The cantilevered beam 14 can be cycled millions of times without any change of properties.

Those skilled in the art should recognize that thermal actuators using the intermetallic titanium aluminide material for layer 36 material can be incorporated onto CMOS wafers allowing integrated control circuitry. Further, the titanium aluminide material can be deposited with the standard sputtering systems used in CMOS wafer fabrication. In addition, the titanium aluminide material can be etched and patterned with the standard chlorine-based etch systems used in CMOS wafer fabrication. The temperatures at which the titanium aluminide material is deposited are below 350° C. This allows easy integration of the thermal actuator device of the present invention into the back end of a CMOS fabrication process.

Intermetallic titanium aluminide has a resistivity of 160 $\mu$ohm-cm which is a reasonable resistivity for a heater. By comparison, pure metals have a much lower resistivity. The intermetallic titanium aluminide material can therefore be used as both the heater and bending element in the thermal actuator.

Intermetallic titanium aluminide has a very low TCR (thermal coefficient of resistance) of <10 ppm which means as the actuator heats up its resistance stays the same. Practically, this means that for an applied voltage pulse to heat the material the current stays the same, thereby allowing a completely linear response.

The thermal actuator of the present invention can also be applied to other microelectro mechanical systems (MEMS). For example, a thermally actuated microvalve could be constructed to control the flow of fluids. The motion provided by the thermal actuator of the present invention could be used for micropostioning or switching applications. Other forms of thermal actuators could also be constructed in accordance with the principles of the preferred embodiment. A buckling actuator could be constructed out of intermetallic titanium aluminide.

From the foregoing, it will be seen that this invention is one well adapted to obtain all of the ends and objects hereinabove set forth together with other advantages which are apparent and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth and shown in the accompanying drawings is to be interpreted as illustrative and not in an illuminating sense.

Parts List

10 thermal actuator inkjet printhead
12 an array of thermal actuator inkjet devices
13 a substrate
14 cantilevered element or beam
16 ink chamber
18 nozzle or port
20 pumping section
22 free end
26 open regions
28 ink feed channel
30 addressing electrodes
32 addressing electrodes
34 first or top layer
36 second or bottom layer
40 thin layer
41 dielectric layer
42 polyimide sacrificial layer
43 flat top surface
44 chamber wall layer
45 sloped sidewalls
46 top wall layer

What is claimed is:

1. A thermal actuator for a micro-electromechanical device comprising:

(a) a base element;

(b) a cantilevered element extending from the base element and residing in a first position, the cantilevered element including a first layer constructed of a dielectric material having a low thermal coefficient of expansion and a second layer attached to the first layer, the second layer comprising intermetallic titanium aluminide wherein the intermetallic titanium aluminide is from about 65% to about 85% aluminum and from about 15% to about 35% titanium by mole fraction; and (c) a pair of electrodes connected to the second layer to allow an electrical current to be passed through the second layer to thereby cause the temperature of the second layer to rise, the cantilevered element deflecting to a second position as a result of the temperature rise of the second layer and returning to the first position when the electrical current through the second layer is ceased and the temperature thereof decreases.

2. A thermal actuator as recited in claim 1 wherein:

the second layer can be characterized by the relationship $$Al_{4-x}Ti_x,$$

where $0.6 \leqq x \leqq 1.4$.

3. A thermal actuator as recited in claim 1 wherein:

the second layer has an efficiency ($\epsilon$) greater than about 1, the efficiency ($\epsilon$) being defined by the equation $$\epsilon = Y\alpha / c_p \rho$$

where Y is Young's modulus, $\rho$ is density, $\alpha$ is the thermal coefficient of expansion, and $c_p$ is the specific heat.

4. A thermal actuator as recited in claim 3 wherein:

the second layer has an efficiency ($\epsilon$) greater than 1.

5. A thermal actuator as recited in claim 3 wherein:

the second layer has an efficiency ($\epsilon$) greater than 1.1.

6. A thermal actuator as recited in claim 1 wherein:

the second layer is a deposited thin film.

7. A thermal actuator for a micro-electromechanical device comprising:

(a) abase element;

(b) a cantilevered element extending from the base element and residing in a first position, the cantilevered element including a first layer constructed of a dielectric material having a low thermal coefficient of expansion and a second layer attached to the first layer, the second layer composed of an electrically conductive material having an efficiency ($\epsilon$) that is greater than about 1 and is defined by the equation $$\epsilon = Y\alpha / c_p \rho$$

where Y is Young's modulus, $\rho$ is density, $\alpha$ is the thermal coefficient of expansion, and $c_p$ is the specific heat; and (c) a pair of electrodes connected to the second layer to allow an electrical current to be passed through the second layer to thereby cause the temperature of the second layer to rise, the cantilevered element deflecting to a second position as a result of the temperature rise of the second layer and returning to the first position when the electrical current through the second layer is ceased and the temperature thereof decreases.

8. A thermal actuator as recited in claim 7 wherein:

the second layer is an intermetallic titanium aluminide that can be characterized by the relationship $$Al_{4-x}Ti_x,$$

where $0.6 \leqq x \leqq 1.4$.

9. A thermal actuator as recited in claim 7 wherein:

the second layer has an efficiency ($\epsilon$) greater than 1.

10. A thermal actuator as recited in claim 7 wherein:

the second layer has an efficiency ($\epsilon$) greater than 1.1.

11. A thermal actuator as recited in claim 7 wherein:

the second layer is a deposited thin film.

12. A thermal actuator inkjet device comprising:

(a) an ink chamber formed in a substrate;

(b) a cantilevered element extending from a wall of the ink chamber and normally residing in a first position, the cantilevered element including a first layer constructed of a dielectric material having a low thermal coefficient of expansion and a second layer attached to the first layer, the second layer comprising intermetallic titanium aluminide wherein the intermetallic titanium aluminide is from about 65% to about 85% aluminum and from about 15% to about 35% titanium by mole fraction, the cantilevered element having a free end residing proximate to an ink ejection port in the ink chamber; and (c) a pair of electrodes connected to the second layer to allow an electrical current to be passed through the second layer to thereby cause the temperature of the second layer to rise, the cantilevered element deflecting to a second position as a result of the temperature rise of the second layer and returning to the first position when the electrical current through the second layer is ceased and the temperature thereof decreases, the movement of the cantilevered element causing ink in the ink chamber to be ejected through the ink ejection port.

13. A thermal actuator inkjet device as recited in claim 12 wherein:

the ink chamber includes a pumping section, the free end of the cantilevered element residing in the pumping section.

14. A thermal actuator inkjet device as recited in claim 13 further comprising:

(a) at least one open region adjacent the cantilevered element; and (b) an ink delivery channel in the substrate allowing ink to be delivered through the at least one open region and into the ink chamber.

15. A thermal actuator inkjet device as recited in claim 12 wherein:

the second layer can be characterized by the relationship $$Al_{4-x}Ti_x,$$

where $0.6 \leqq x \leqq 1.4$.

16. A thermal actuator inkjet device as recited in claim 12 wherein:

the second layer has an efficiency ($\epsilon$) greater than about 1, the efficiency ($\epsilon$) being defined by the equation $$\epsilon = Y\alpha / c_p \rho$$

where Y is Young's modulus, $\rho$ is density, $\alpha$ is the thermal coefficient of expansion, and $c_p$ is the specific heat.

17. A thermal actuator inkjet device as recited in claim 16 wherein:

the second layer has an efficiency ($\epsilon$) greater than 1.

18. A thermal actuator inkjet device as recited in claim 16 wherein:

the second layer has an efficiency ($\epsilon$) greater than 1.1.

19. A thermal actuator inkjet device as recited in claim 12 wherein:

the second layer is a deposited thin film.

* * * * *